US006406076B1

(12) United States Patent
Zarzycki, Jr.

(10) Patent No.: US 6,406,076 B1
(45) Date of Patent: Jun. 18, 2002

(54) LATCH GUARD

(76) Inventor: Vincent Zarzycki, Jr., 9098 Diplomat Pl., Philadelphia, PA (US) 19115

( * ) Notice: Subject to any disclaimer, the term of this patent is extended or adjusted under 35 U.S.C. 154(b) by 0 days.

(21) Appl. No.: 09/481,061

(22) Filed: Jan. 11, 2000

(51) Int. Cl.[7] ..... E05B 17/00
(52) U.S. Cl. ..... 292/346; 70/417
(58) Field of Search ..... 49/460, 462; 70/416, 70/417, 418; 292/340, 346

(56) References Cited

U.S. PATENT DOCUMENTS

| | | | | |
|---|---|---|---|---|
| 3,060,523 A | | 10/1962 | Benham | |
| 3,377,094 A | * | 4/1968 | Thompson | 292/346 |
| 3,405,962 A | * | 10/1968 | Sushan | 292/346 |
| 3,645,045 A | | 2/1972 | Gervis et al. | |
| 3,761,119 A | | 9/1973 | Bennett et al. | |
| 4,237,712 A | | 12/1980 | Cramer | |
| D259,856 S | * | 7/1981 | Ciener | D8/331 |
| 4,345,787 A | * | 8/1982 | Dabrowski | 292/346 |
| 4,484,463 A | | 11/1984 | Hennessy | |
| 4,492,397 A | * | 1/1985 | Allenbaugh | 292/341.18 |
| 4,720,129 A | * | 1/1988 | Bouchard | 292/346 |
| 5,131,189 A | | 7/1992 | Mascotte | |
| 5,350,207 A | | 9/1994 | Sanders | |
| 5,415,020 A | | 5/1995 | Allenbaugh | |
| 5,547,239 A | | 8/1996 | Allenbaugh | |
| 5,566,995 A | * | 10/1996 | Jagiela | 292/346 |
| 5,678,871 A | | 10/1997 | Zarzycki, Jr. | |

FOREIGN PATENT DOCUMENTS

| | | |
|---|---|---|
| NL | 37315 | 1/1936 |

OTHER PUBLICATIONS

"Thresholds and Weatherstrips," Reese Enterprises, Inc. 1995/1996 Catalog/Brochure of Products.
Pemko 1995 Catalog.

* cited by examiner

*Primary Examiner*—S. Joseph Morano
*Assistant Examiner*—Andrew Wright
(74) *Attorney, Agent, or Firm*—Woodcock Washburn LLP

(57) ABSTRACT

A latch guard is secured to the surface of a door to which a door's latching mechanism is secured and therefore cannot be removed when the door is in a closed position. The latch guard comprises a latch bolt tumbler, a face plate integrally formed with the latch bolt tumbler, and a protection bar formed integrally with the face plate. The face plate aligns with the surface of the door and therefore is acceptable for use with door and door frame combinations having little clearance there between. According to another aspect of the invention, a latch guard system comprises a latch guard and a strike plate. The strike plate has a recess area formed therein to accommodate the latch guard when the door is closed upon the door frame.

3 Claims, 5 Drawing Sheets

FIG. 3
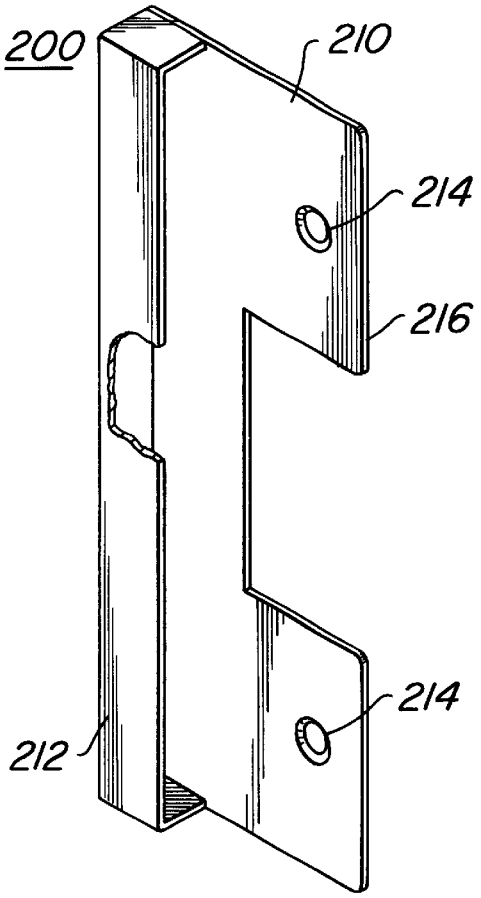
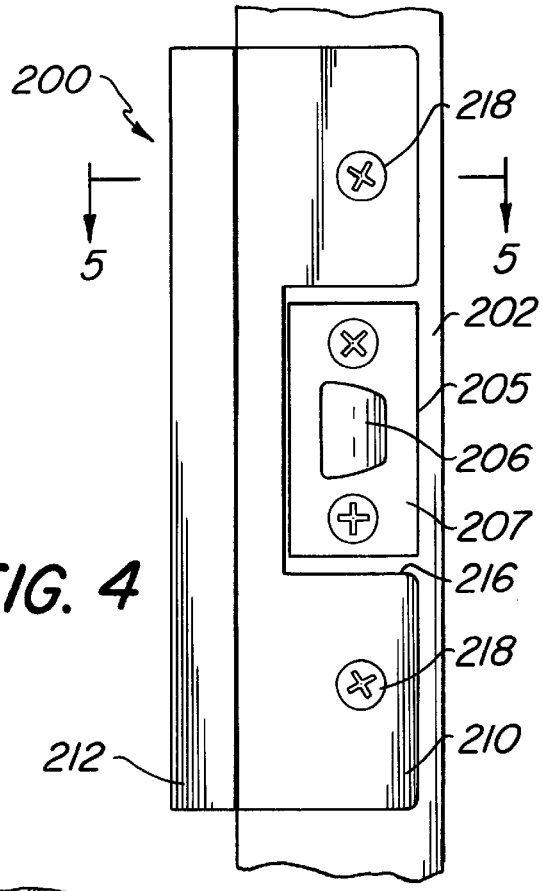
FIG. 4
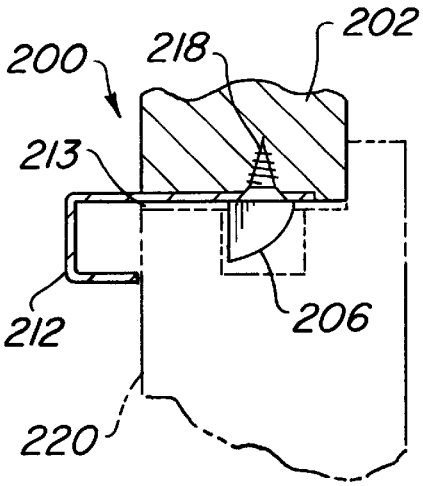
FIG. 5
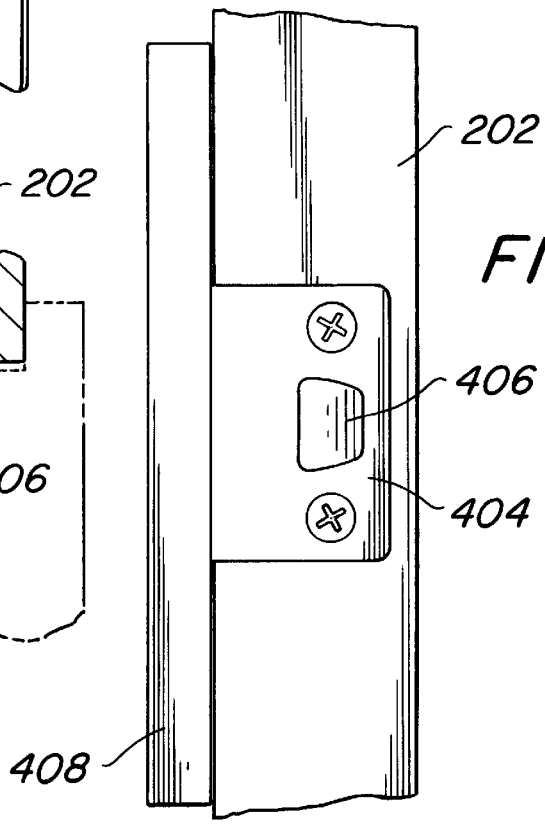
FIG. 11

FIG. 6
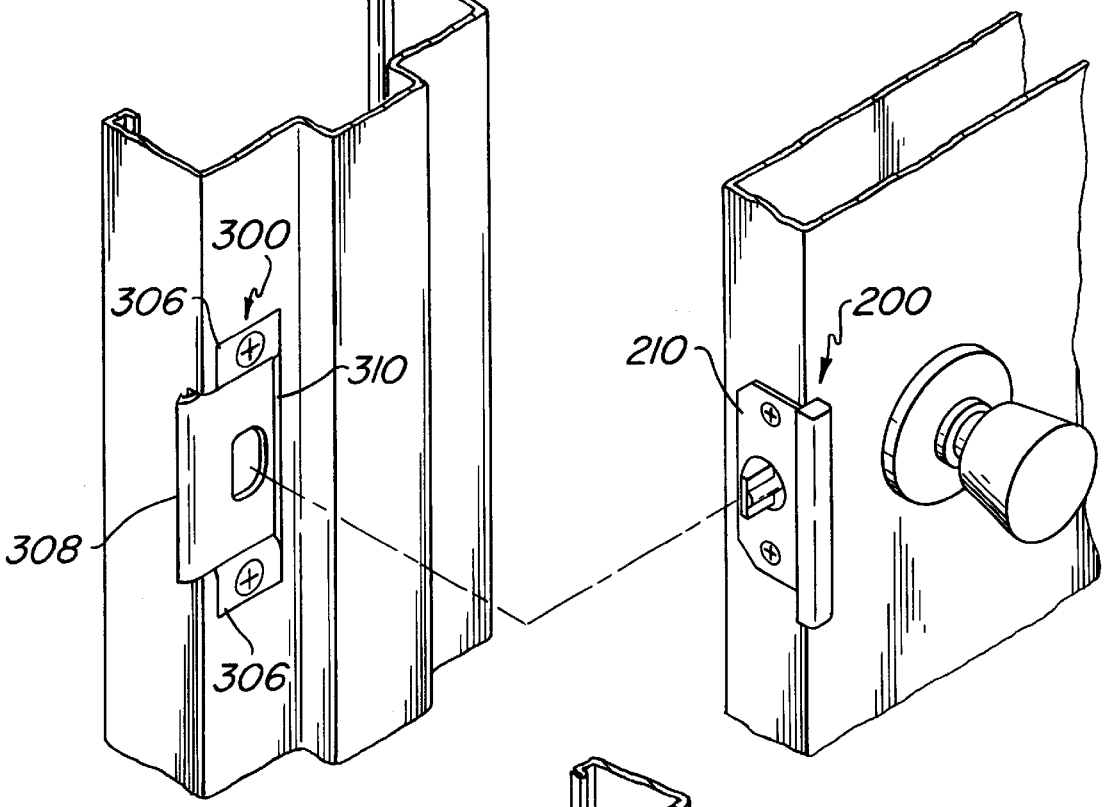
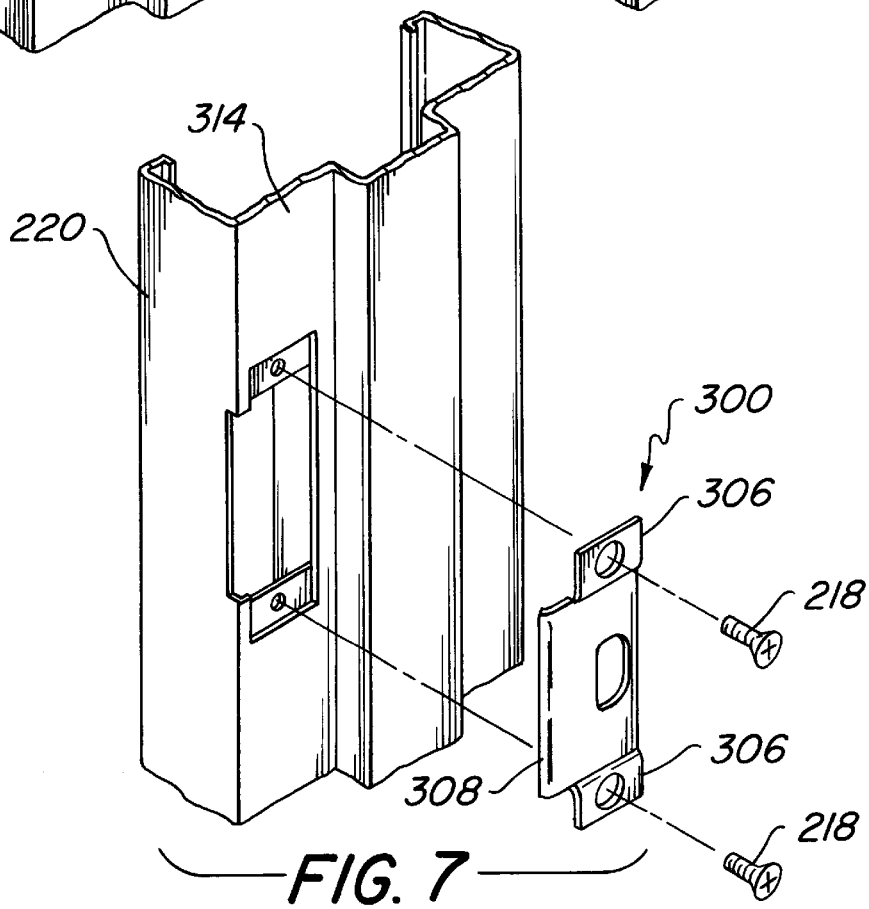
FIG. 7

210
216
218
206
205
202
212
200

LATCH GUARD

FIELD OF THE INVENTION

The present invention relates generally to a latch guard used to secure a door latching mechanism from tampering. More particularly, the present invention relates to an improved latch guard that can be easily installed on the face of the door on which the latching mechanism is secured.

BACKGROUND OF THE INVENTION

Conventional door locking mechanisms typically utilize a retractable spring-loaded latch operated by a door knob. When the door is closed, the latch contacts a strike plate causing the latch to recede within the door until it is aligned with a recess formed within the door frame or jamb. Once the latch is aligned, the latch springs into the recess in the door jamb or frame. The latch can be retracted out of the recess in the door jamb using a door knob or handle so as to open the door.

A problem with door and door latching mechanisms is that they can be easily violated. For example, a latch can be disengaged from the recess in the door jamb and the door opened by sliding a credit card or similar flexible material between the door jamb and door. The latch might alternatively be disengaged from the recess in the door jamb by inserting rigid objects such as screwdrivers and crowbars in the gap between the door and the door jamb. Thus, there is a problem in the art of unwanted tampering with door latching mechanisms.

There have been several attempts made to address this problem. U.S. Pat. No. 5,415,020 ('020 Patent) entitled "Latch Guard for Outwardly Opening Doors" and U.S. Pat. No. 5,547,239 ('239 Patent) entitled "Latch Guard For Center Hung Doors" disclose latch guards for protecting against tampering with a door's latching mechanism. FIG. 1 provides a view of a latch guard with features in accordance with those of the '020 and '239 Patents. Both the '020 and '239 Patents purport to address the problem of tampering with the latching mechanism by attaching a plate of some sort to the front of the exterior door face.

The plate bridges the gap between the door to which the plate is attached and either an opposing door or door frame. The latch guard operates to impede a prospective intruder from inserting a foreign device between the door and the door jamb or between two adjoining doors for purposes of tampering with the door latch.

Of course, there are problems associated with latch guards such as those disclosed in the '020 and '239 Patents. Latch guards in accordance with those disclosed in the '020 and '239 Patents are secured to the door on the exterior portion of the door. In most instances doors are not reinforced in these areas. In addition, because the mechanism by which the latch guard is secured to the door is accessible to would be intruders, the latch guard can be removed so as to provide access to the door latching mechanism. Further, such latch guards must be sufficiently wide to cover the gap between a door and door jamb. However, as a consequence, when the door opens, the latch guard extends beyond the edge of the door to which it is attached. The overlapping latch guard may catch and thereby damage people's clothing as they walk past the open door. Additionally, it may not be aesthetically pleasing to have a latch guard mounted on the exterior surface of a door.

Accordingly, a primary goal of the present invention is to provide a latch guard that is secure against unauthorized removal, does not significantly overlap the edge of a door, and does not detract from the door's aesthetics.

SUMMARY OF THE INVENTION

A latch guard in accordance with the present invention addresses these and other shortcomings in the art. According to one aspect of the invention there is provided a latch bolt guard assembly for protecting a latch bolt of a door from tampering. The door has a surface for attachment thereto of a latch bolt assembly, which surface faces an interior surface of a door jamb when the door is in the closed position. The latch bolt guard assembly comprises the following elements: a latch bolt tumbler assembly; a face plate integrally formed with the latch bolt tumbler; and a protection bar integrally formed with the face plate. The protection bar substantially fills a gap between the door and the door jamb as viewed from an exterior side of the door when the door is in a closed position. The face plate may have a receptacle therein through which a latch bolt extends. The face plate may have holes therein for securing the assembly to the door.

According to another aspect of the invention, there is disclosed a latch bolt guard system for application to a door and door jamb combination. The latch bolt guard system comprises a latch guard and a strike plate. The latch guard has a face plate for attaching the latch guard to the door, and a protection bar attached to the face plate. The protection bar substantially fills a gap between the door and the door jamb as viewed from an exterior side of the door when the door is in a closed position. The strike plate has a first securing area and a second securing area with a latch strike surface disposed there between. The latch strike surface is offset relative to the first securing area and the second securing area so as to form a recess. When the strike plate is attached to the door frame and the door is closed upon the door frame, the face plate aligns with the latch strike surface and the face plate is accommodated by the recess.

According to another aspect of the invention, there is disclosed a latch bolt protection system for application to a door. The latch bolt protection system comprises a latch bolt assembly and a latch guard. The latch bolt assembly has a latch bolt assembly face plate, wherein the latch bolt assembly is countersunk into the surface of the door so that the latch bolt assembly face plate is offset into the door away from the surface of the door. The latch guard has a guard face plate for attaching the latch guard over the latch bolt assembly face plate, and a protection bar integrally formed with the latch guard face plate. The guard face plate is smaller than the latch bolt assembly face plate so that the latch guard face plate can be applied over the latch bolt assembly face plate. The latch guard face plate aligns flush with an exterior surface of the door.

Other features of the present invention are described below.

BRIEF DESCRIPTION OF THE DRAWINGS

A full understanding of the invention can be gained from the following description of preferred embodiments when read in conjunction with the accompanying drawings in which:

FIG. 3 is an isolated view of a latch guard in accordance with the present invention;

FIG. 4 is another view of a latch guard in accordance with the present invention attached to a door;

FIG. 5 is a cross-sectional view of the latch guard and door shown in FIG. 4;

FIG. 6 is an exploded view of a door and a strike plate in accordance with the present invention;

FIG. 7 is an exploded view of a strike plate and latch guard in accordance with the present invention;

FIG. 11 is a view of a latch bolt assembly in accordance with the present invention.

DETAILED DESCRIPTION OF PREFERRED EMBODIMENTS

A latch guard with the above-mentioned beneficial features in accordance with a presently preferred exemplary embodiment of the invention will be described below with reference to FIGS. 2 through 11. It will be appreciated by those of ordinary skill in the art that the description given herein with respect to those figures is for illustrative purposes only and is not intended in any way to limit the scope of the invention. All questions regarding the scope of the invention may be resolved by referring to the appended claims.

Figure 1:
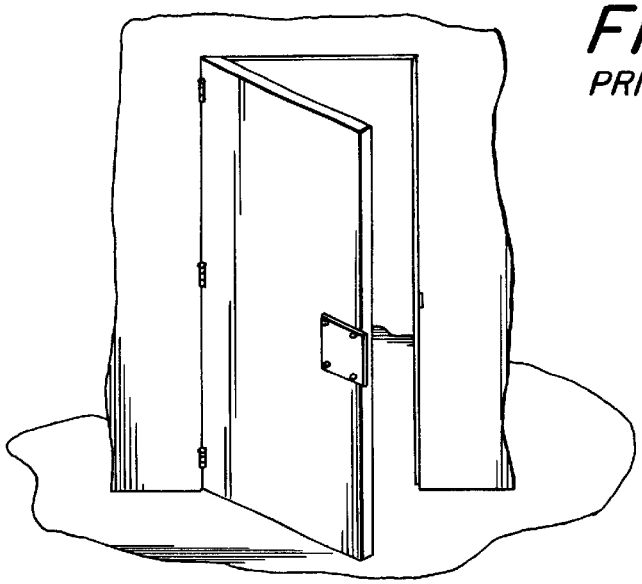
FIG. 1 PRIOR ART
FIG. 1 is a perspective view of a prior art latch guard in a standard door jamb.
Figure 2:
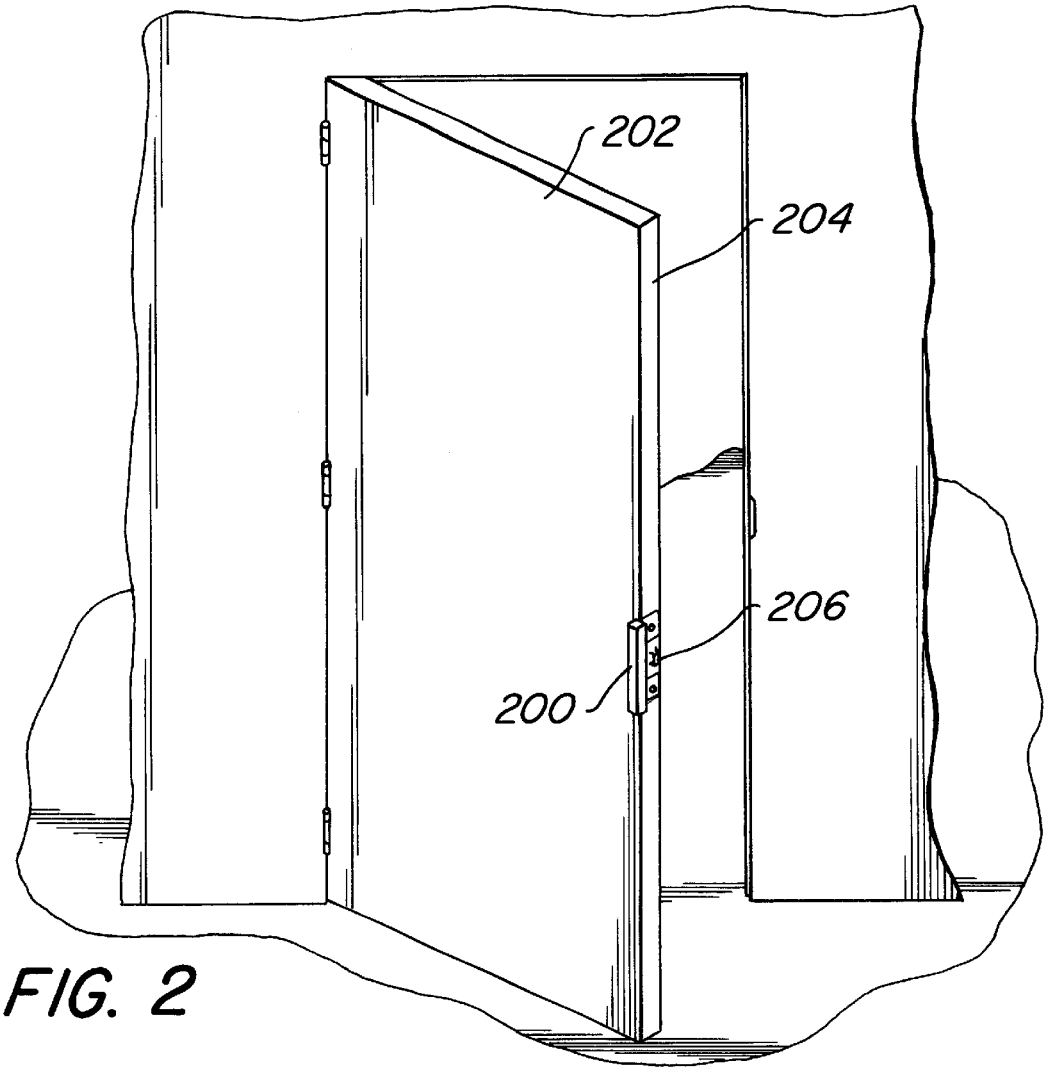
FIG. 2 is a perspective view of a latch guard in accordance with the present invention attached to a door.

FIG. 2 provides a perspective view of latch guard 200 in accordance with the present invention attached to door 202. As shown, and in contrast to the prior art described above with reference to FIG. 1, latch guard 200 is attached to surface 204 of door 202 to which latch 206 is secured. Typically, doors are reinforced in these areas, thus making it a better location for securing a latch guard than the exterior surface of the door. Further, surface 204 of door 202 is a better location for security purposes as well. When latch guard 200 is attached on surface 204 of door 202, and the door is closed, would be intruders are denied access to the screws or other means by which latch guard 200 is secured. Thus, intruders are not able to remove latch guard 200 as they may be able with guards such as those shown in FIG. 1. Further, latch guard 200 does not overhang the edge of door 200 to the extent that prior latch guards may. Therefore, there is less likelihood that latch guard 200 will catch a person's clothing. Also, latch guard 200 provides a more aesthetically appealing door than do the latch guards described above.

FIG. 3 provides an isolated view of an embodiment of the inventive latch guard 200. In the shown embodiment, latch guard 200 comprises face plate 210 and protection bar 212. Face plate 210 has holes 214 situated therein, through which screws may be inserted for securing latch guard 200. Protection bar 212 is integrally attached or formed with face plate 210. Protection bar 212 has a width sufficient to fill the gap between a door and the door jamb and is sufficiently long to preclude tampering. A receptacle or cut-out 216 along an edge of face plate 210 provides room for latch guard 200 to be secured around a door latch. Receptacle 216 could alternatively be a cut-out in the interior body, as opposed to the edge of face plate 210. Face plate 210 and protection bar 212 are preferably made from metal. More preferably, face plate 210 and protection bar 212 preferably have a chrome or brass finish.

FIG. 4 provides an enlarged view of latch guard 200 of FIG. 3 attached to door 202. Latch bolt assembly 205 which comprises face plate 207 and latch bolt 206 is inserted in a recess in door 202. Face plate 210 of latch guard 200 is attached to door 202 using screws 218 which have been driven through holes 214 into door 202. Face plate 210 has an opening or receptacle 216 situated therein so as to accommodate latch bolt 206. Protection bar 212 extends along the edge of door 202. Protection bar 212 has a width such that when door 202 is closed, the gap between door 202 and the door jamb is filled. By filling this gap, latch guard 200 precludes tampering with door latch 204. It should be noted, that in an alternative embodiment of the present invention the same fastening means, for example screws 218, can be used to secure latch guard 200 and latch assembly 205.

FIG. 5 provides a sectional view of latch guard 200 shown in FIG. 4. As shown, latch guard 200 is connected to door 202 using screw 218. Latch bolt 206 projects away from door 202 into a recess in door jamb 220. Protection bar 212 overlaps gap 213 between door 202 and door jamb 220 thus preventing tampering with latch bolt 206. Because door 202 is closed on door jamb 220, screws 218 by which latch guard 200 is attached to door 202 are protected from tampering and removal of latch guard 200.

In some door and door frame combinations there is very little clearance between the door and door jamb, i.e. gap 213 is small. As a consequence, attaching a latch guard to the surface of the door which closes upon the door jamb may not be possible due to the lack of clearance. Thus, Applicant has developed several inventive embodiments that compensate for the lack of clearance between the door and the door jamb.

According to one embodiment, face plate 210 of latch guard 200 has a surface area equal to or smaller than latch assembly face plate 207. Such an embodiment is ideal for door arrangements with little clearance. Typically, latch assembly face plate 207 is arranged flush with the surface of door 202. However, it is possible to countersink latch assembly face plate 207 so as to leave an offset or recess between the exterior surface of latch assembly face plate 207 and the surface of door 202. When latch assembly face plate 207 is offset, latch guard 200 having a face plate 210 with a surface area smaller than that of latch assembly face plate 207 can be positioned over latch assembly face plate 207. Further, because latch guard 200 face plate 210 is smaller than face plate 207, latch guard 200 face plate fits into or is accommodated in the recess formed between the surface of latch assembly 205 face plate 207 and the exterior surface of the door. Accordingly, the exterior surface of latch guard face plate 210 is flush with the exterior surface of door 202. Having face plate 210 of latch guard 200 flush with the exterior of door 202 is ideal for situations where there is little clearance between door 202 and door jamb 220 or door 202 and a second door on which door 202 closes. Thus, a latch bolt assembly comprising latch guard 200 and latch bolt assembly 205 wherein face plate 210 is smaller than latch assembly face plate 207 is particularly useful for doors having little clearance.

Figure 8:
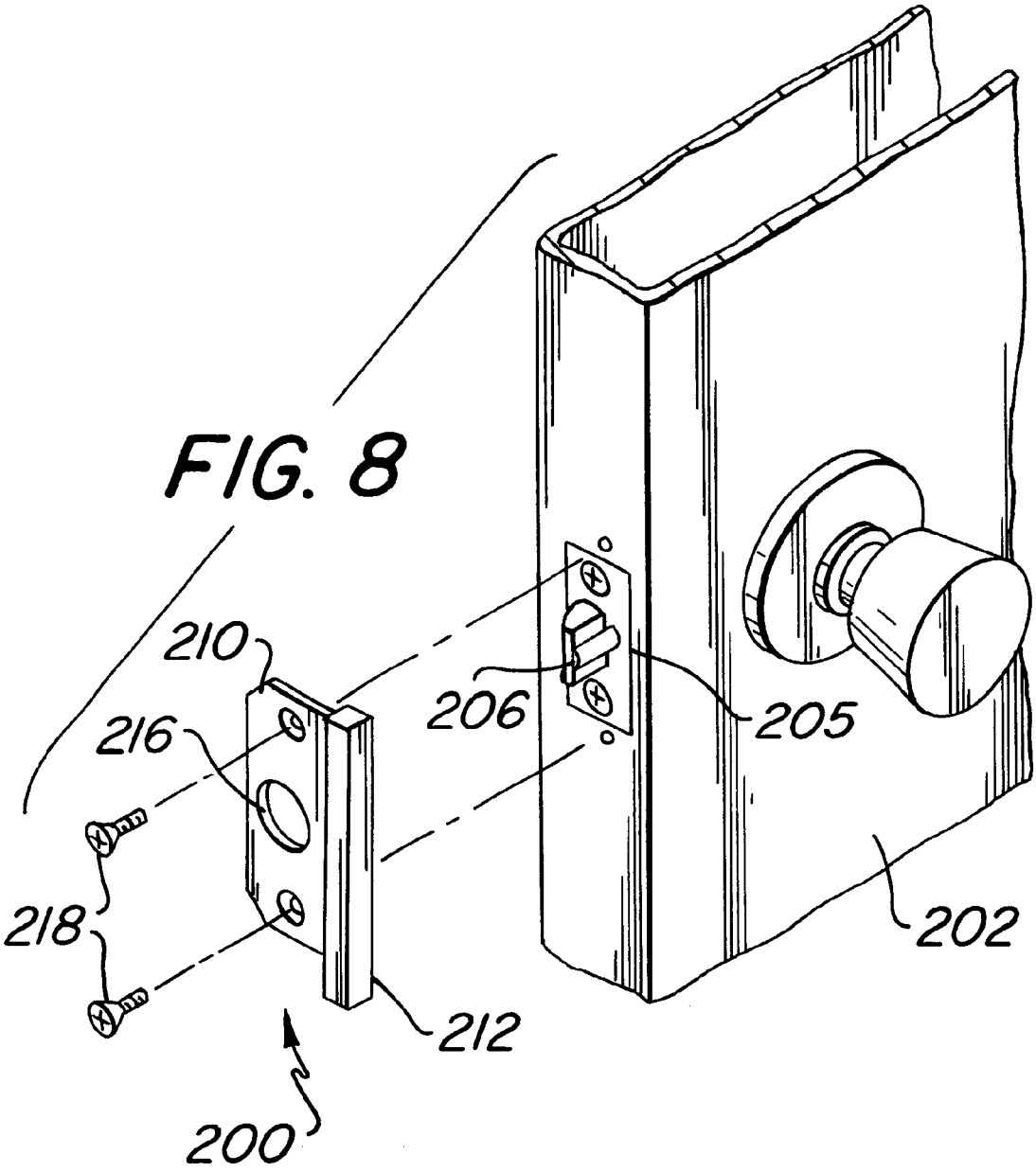
FIG. 8 is an exploded view of a door and a latch guard in accordance with the present invention.

In another embodiment, such as that shown in FIGS. 6–8, latch bolt strike 300 has been recessed to accommodate faceplate 210 of latch guard 200. Latch bolt strike 300 comprises securing areas 306 and strike plate 308. Strike plate 308 is offset relative to securing areas 306 so as to form recess 310 of sufficient size to accommodate the thickness of faceplate 302. Thus, when door 202 is closed upon door frame 220, latch guard face plate 210 is seated in recess 310 formed by the offset of securing areas 306 from strike plate 308.

FIG. 7 provides an exploded isolated view of latch bolt strike 300 and door frame 220. As shown, securing areas 306 align with surface 313 of door frame 220. Securing areas 306 have holes 316 therein for accepting screws 218 which secure latch bolt strike 300 to frame 220. Strike plate 308 is offset from latch bolt strike securing areas 306. When latch bolt strike securing areas 306 are aligned with surface 314 of door frame 220, strike plate 308 is offset into door frame 220.

FIG. 8 provides an exploded isolated view of latch guard 200 and door 202. Latch guard 200 comprises face plate 210 and protection bar 212. Latch guard 200 is applied over latch bolt assembly 205 and is secured to door 202 with securing screws 218. Latch bolt 206 extends through recess 216 formed in face plate 210. When door 200 is closed upon door frame 220, face plate 210 aligns with strike plate 308 and occupies recess 310 formed by the offset between securing areas 306 and strike plate 308. The offset between areas 306 and strike plate 308 is sufficiently large to accommodate the thickness of faceplate 210. Thus, even when very little clearance exists between door 202 and door frame 220, a latch bolt guard system in accordance with the present invention may be employed.

Figure 10:
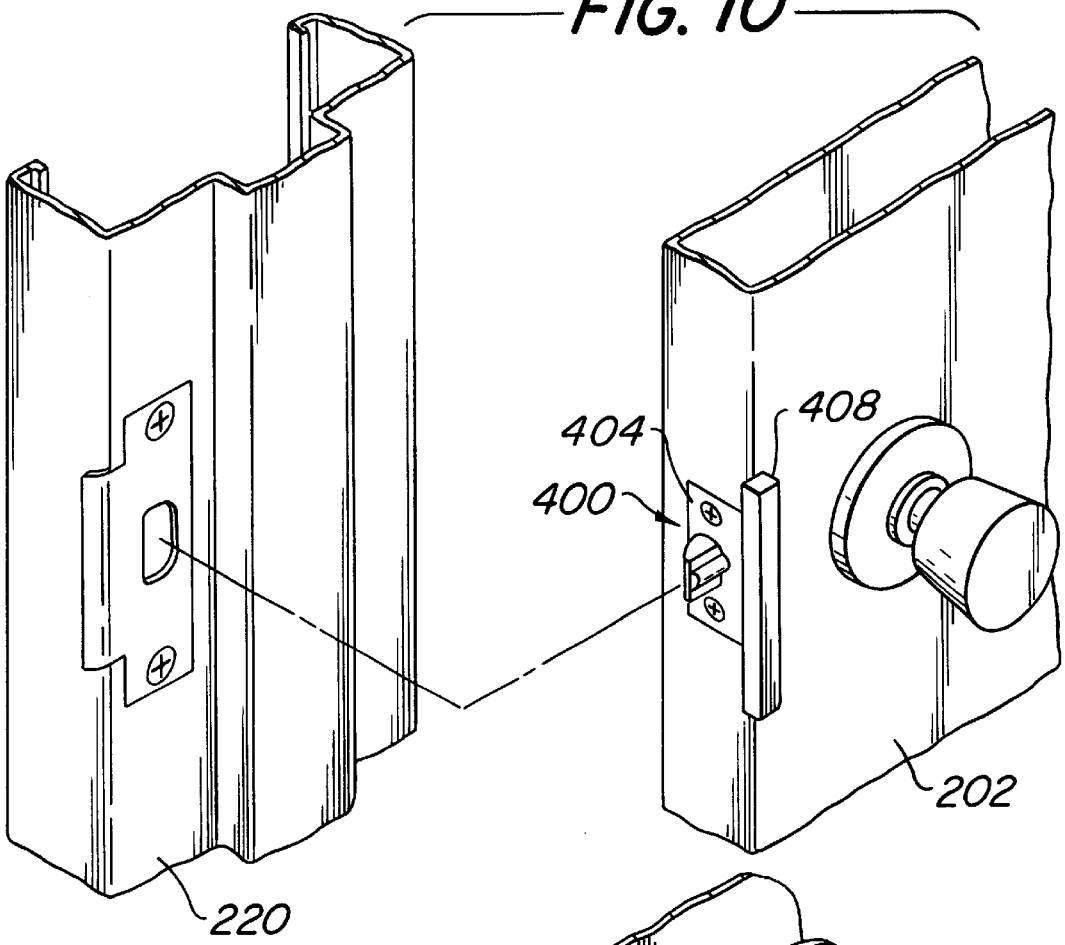
FIG. 10 is an exploded view of a latch bolt assembly and a door frame.
Figure 9:
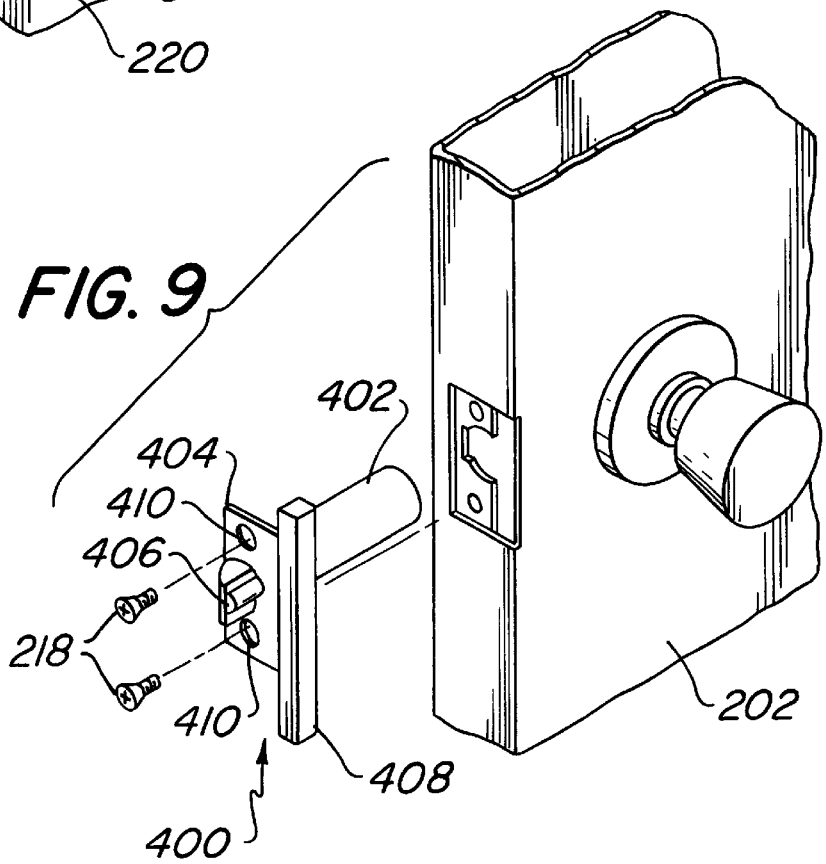
FIG. 9 is an exploded view of a door and a latch bolt assembly in accordance with the present invention.

FIGS. 9 through 11 provide a view of another embodiment of the invention which compensates for minimal clearance between door 202 and door frame 212. As shown in FIG. 9, latch guard 400 comprises latch bolt tumbler 402, face plate 404 with latch bolt 406 extending therefrom, and protection bar 408 integrally formed with face plate 404. Latch bolt tumbler 402 operates similar to equivalent devices in standard latch bolt assemblies. Latch guard 400 is secured to door 202 using screws 218 which extend through holes 410 in faceplate 404 to door 202. Latch bolt 406 is formed integrally with face plate 404. Protection bar 408, has a width sufficient to fill a gap between door 202 and a door jamb 220. Holes 410 in faceplate 404 are positioned such that face plate 404 and latch 406 can be secured to door 202 in the same location as a typical latch assembly. Thus, no special preparation of door 202 or fastening means are necessary when employing latch guard 400.

As shown in FIG. 10, when latch guard 400 is secured to door 202, protection bar 408 extends along the comer of door 202. Face plate 404 is aligned flush with the surface of door 202 to which latch guard 400 is attached. Thus, when door 202 is closed upon door frame 220, face plate 404 does not interfere with closing even under circumstances where very little clearance exists between door 202 and door frame 220. FIG. 11 provides a frontal view of the latch guard shown in FIGS. 9 and 10.

The present invention may be employed in other specific forms without departing from the spirit or essential attributes thereof For example, a face plate or protection bar with a different shape than that described and shown above could be used. Accordingly, the scope of protection of the following claims is not limited to the presently preferred embodiment disclosed above.

I claim:

1. A latch bolt guard system for application to a door and door frame combination, comprising:

a latch guard having a face plate for attaching said latch guard to the door, and a protection bar attached to said face plate, said protection bar substantially filling a gap between the door and the door jamb as viewed from an exterior side of the door when the door is in a closed position; and a strike plate for attaching to the door frame, said strike plate having a first securing area and a second securing area extending in a common plane with a latch strike surface disposed there between, said latch strike surface being offset relative to said first securing area and said second securing area so as to form a recess, wherein when said strike plate is attached to the door frame, said latch guard is applied to the door, and the door is closed upon the door frame, said first securing area and said second securing area align with the surface of the door to which the latch guard is attached, said face plate aligns with said latch strike surface, and said face plate is accommodated by said recess.

2. The latch bolt guard system of claim 1 wherein said face plate has a receptacle therein through which a latch bolt extends.

3. The latch bolt guard system of claim 1 wherein said face plate has holes therein for securing said assembly to the door.

* * * * *

UNITED STATES PATENT AND TRADEMARK OFFICE

CERTIFICATE OF CORRECTION

PATENT NO. : 6,406,076 B1
DATED : June 18, 2002
INVENTOR(S) : Vincent Zarzycki Jr.

It is certified that error appears in the above-identified patent and that said Letters Patent is hereby corrected as shown below:

Column 3,
Line 46, delete “200” after “door” and insert -- 202 --;

Column 6,
Line 9, delete “there For” and insert -- thereof. For -- therefor.

Signed and Sealed this

Fourteenth Day of January, 2003

JAMES E. ROGAN
*Director of the United States Patent and Trademark Office*